US011007114B1

(12) United States Patent
Wang

(10) Patent No.: US 11,007,114 B1
(45) Date of Patent: May 18, 2021

(54) ACUPRESSURE NODE GARMENT

(71) Applicant: Helena Wang, Roslyn Harbor, NY (US)

(72) Inventor: Helena Wang, Roslyn Harbor, NY (US)

( * ) Notice: Subject to any disclaimer, the term of this patent is extended or adjusted under 35 U.S.C. 154(b) by 96 days.

(21) Appl. No.: 16/852,389

(22) Filed: Apr. 17, 2020

(51) Int. Cl.
*A61H 39/04* (2006.01)
*A61H 15/00* (2006.01)
*A41B 1/08* (2006.01)

(52) U.S. Cl.
CPC ..... *A61H 39/04* (2013.01); *A41B 1/08* (2013.01)

(58) Field of Classification Search
CPC ..... A61H 39/04; A61H 39/00; A61H 39/02; A61H 37/00; A61H 36/00; A61H 2201/1652; A61H 2201/1645; A41B 1/08; A41B 1/10; A61B 2400/322
See application file for complete search history.

(56) References Cited

U.S. PATENT DOCUMENTS

| | | | | |
|---|---|---|---|---|
| 6,763,525 | B1 * | 7/2004 | Spector | A61H 39/04 2/115 |
| 2004/0230146 | A1 * | 11/2004 | Chang | A61H 7/001 601/134 |
| 2015/0112380 | A1 * | 4/2015 | Heller | A61H 39/04 606/201 |
| 2018/0242667 | A1 * | 8/2018 | Horton | A41D 1/18 |
| 2019/0110538 | A1 * | 4/2019 | Ghasletwala | A41D 10/00 |

* cited by examiner

*Primary Examiner* — Anh T Dang
(74) *Attorney, Agent, or Firm* — Kelley Drye & Warren LLP

(57) ABSTRACT

Articles of clothing and accessories with one or more integrated nodes that facilitate application of pressure to one or more acupoints on the body of a person wearing the article.

16 Claims, 7 Drawing Sheets

ACUPRESSURE NODE GARMENT

BACKGROUND OF THE INVENTION

Acupuncture and acupressure are methods used by acupuncturists to stimulate acupoints (also referred to as acupuncture points or acupressure points) in the body to facilitate health and wellness. Each individual has hundreds of acupoints. Acupuncture uses a hair-thin needle to stimulate an acupoint. Acupressure, also referred to as pressure acupuncture, applies the same principles as acupuncture to promote health and wellness, but uses firm pressure to massage the acupoints instead of needles.

Acupoints lie along meridians, or channels, in the body. It is believed that 12 meridians connect specific organs or networks of organs, forming a system of communication throughout the body. When a meridian is blocked or out of balance, acupressure or acupuncture may help restore balance. Specifically, applying pressure to acupoints can restore balance to the body's channels of energy. For example, activating an acupoint named "large intestine 11" on the top of the forearm and in line with the elbow may help clear heat out of the body (e.g., hot flashes, fever) and help alleviate constipation. Western medical practitioners attribute positive results achieved by acupuncture and acupressure to factors such as reduced muscle tension, improved circulation, or stimulation of endorphins, which are natural pain relievers.

To locate acupoints, acupuncturists use a unit of measurement called a "cun." The length of a cun for each person is dependent on the size of the person and, specifically, the dimensions of the person's hand. But on average a cun is approximately 1.31 inches. A length of a person's forearm is typically 12 cun. Acupuncturists can determine acupoints along the channels of the body, starting from certain landmarks, such as the apex of the shoulder blade, and spaced apart by a certain number of cun.

SUMMARY OF THE INVENTION

The present invention is directed to articles of clothing that facilitate application of pressure to one or more acupoints on the body of a person wearing the article.

One or more nodes may be located on the article of clothing. The location of the one or more nodes may coincide with the location of one or more acupoints on a person's body. When the article of clothing is worn and pressure is applied to a node in the direction of the surface of the wearer's body, the node may impinge on an acupoint and may confer some or all of the benefits achieved when an acupuncturist applies pressure to the acupoint. Accordingly, each article of clothing may be tailored to address desired health or wellness conditions It is an object of the present invention to provide greater control over the timing and intensity of pressure applied to acupoints. The present invention allows wearers to realize at least some of the benefits of acupressure without visiting an acupuncturist. Also, by laying down on a flat surface or otherwise pressing the body against a surface, pressure may be applied to multiple nodes causing stimulation of multiple acupoints simultaneously.

It is also an object of the present invention to facilitate finding and applying pressure to acupoints on a wearer's body, even when the wearer cannot see the location of acupoint because the wearer is, for example, in a dark environment, or has impaired vision.

Numerous variations may be practiced in the preferred embodiment.

BRIEF DESCRIPTION OF THE DRAWINGS

A further understanding of the invention can be obtained by reference to exemplary embodiments set forth in the illustrations of the accompanying drawings. Although the illustrated embodiments are merely exemplary of systems, methods, and apparatuses for carrying out the invention, both the organization and method of operation of the invention, in general, together with further objectives and advantages thereof, may be more easily understood by reference to the drawings and the following description. Like reference numbers generally refer to like features (e.g., functionally similar and/or structurally similar elements).

The drawings are not necessarily depicted to scale; in some instances, various aspects of the subject matter disclosed herein may be shown exaggerated or enlarged in the drawings to facilitate an understanding of different features. Also, the drawings are not intended to limit the scope of this invention, which is set forth with particularity in the claims as appended hereto or as subsequently amended, but merely to clarify and exemplify the invention.

DETAILED DESCRIPTION OF THE INVENTION

Figure 1:
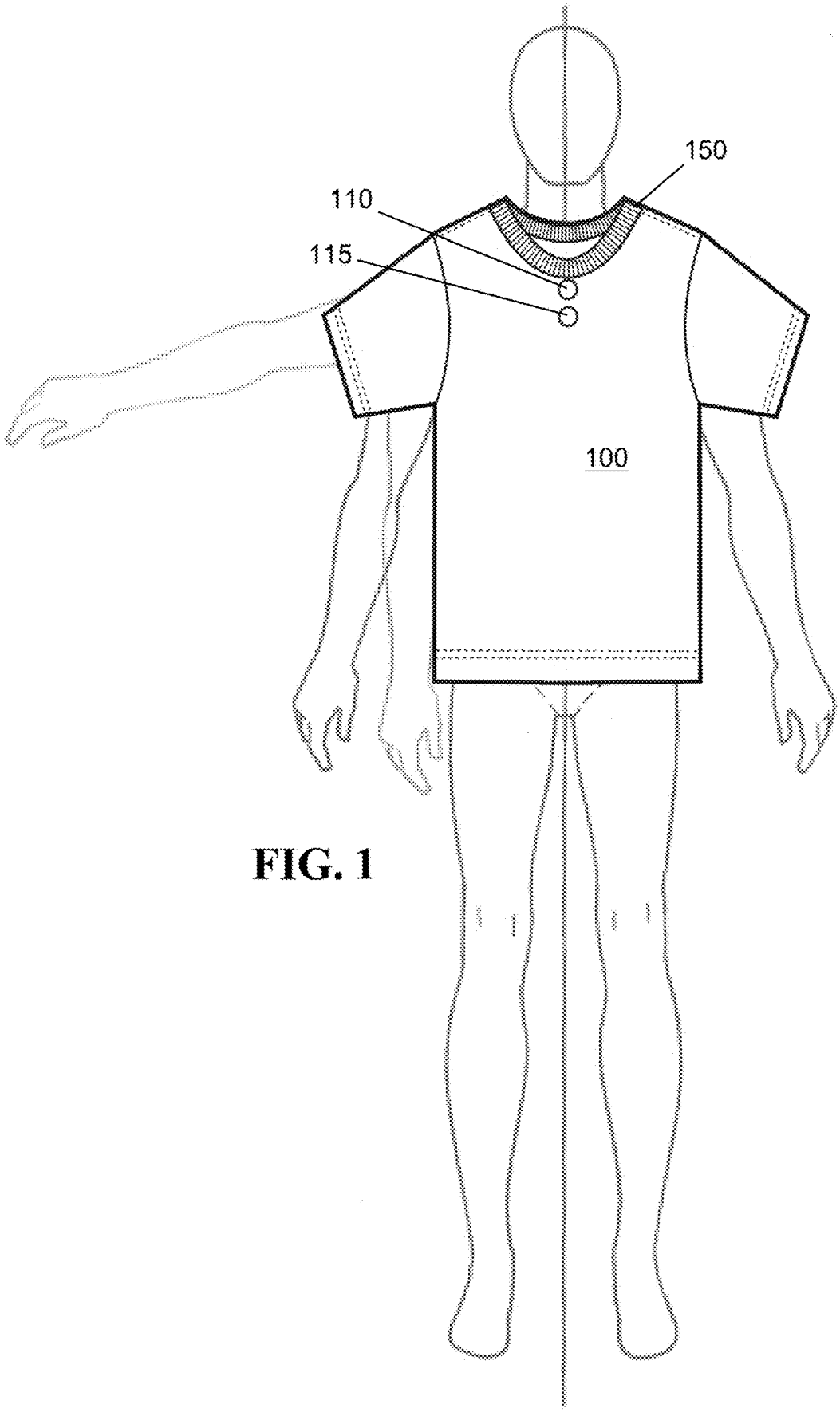
FIG. 1 depicts an exemplary embodiment of the present invention.

The invention may be understood more readily by reference to the following detailed descriptions of embodiments of the invention. However, techniques, systems, and operating structures in accordance with the invention may be embodied in a wide variety of forms and modes, some of which may be quite different from those in the disclosed embodiments. Also, the features and elements disclosed herein may be combined to form various combinations without exclusivity, unless expressly stated otherwise. Consequently, the specific structural and functional details disclosed herein are merely representative. Yet, in that regard, they are deemed to afford the best embodiments for purposes of disclosure and to provide a basis for the claims herein, which define the scope of the invention. It should also be noted that, as used in the specification and the appended claims, the singular forms "a", "an", and "the" include plural referents unless the context clearly indicates otherwise.

Use of the term "exemplary" means illustrative or by way of example, and any reference herein to "the invention" is not intended to restrict or limit the invention to the exact features or steps of any one or more of the exemplary embodiments disclosed in the present specification. Also, repeated use of the phrase "in one embodiment," "in an exemplary embodiment," or similar phrases do not necessarily refer to the same embodiment, although they may. It is also noted that terms like "preferably," "commonly," and "typically," are not used herein to limit the scope of the claimed invention or to imply that certain features are critical, essential, or even important to the structure or function of the claimed invention. Rather, those terms are merely intended to highlight alternative or additional features that may or may not be used in a particular embodiment of the present invention.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical terms used herein have the same meaning as commonly understood by one of ordinary skill in the art to which this invention belongs. Although any methods and materials similar or equivalent to those described herein can be used in the practice or testing of the present invention, some potential and preferred methods and materials are now described.

Referring to FIG. 1, there is shown a garment (100) in accordance with the present invention. Garment (100) is depicted as a t-shirt, but the inventive concepts described herein would also apply to other types of garments, such as long-sleeve shirts, sweaters, dresses, skirts, blouses, pants, shorts, sweatshirts, and undergarments. The inventive concepts would also apply to other products worn on the body, such as scarves, headbands, footwear, jewelry, and other accessories. Garment (100) includes a collar (150). Immediately below collar (150) are nodes (110, 115). The location of node (110) coincides with a first acupoint at the clavicular-sternum junction. Stimulating the first acupoint by, for example, applying pressure on node (110) so that it presses against the first acupoint, may help alleviate conditions such as asthma, sore throat, hiccups, and difficulty swallowing. A second node (115) located at or approximately 1.31 inches below node (110) coincides with a second acupoint. Stimulating the second acupoint by, for example, applying pressure on node (115) so that it presses against the second acupoint, may help alleviate conditions such as chest paint, cough.

Figure 2:
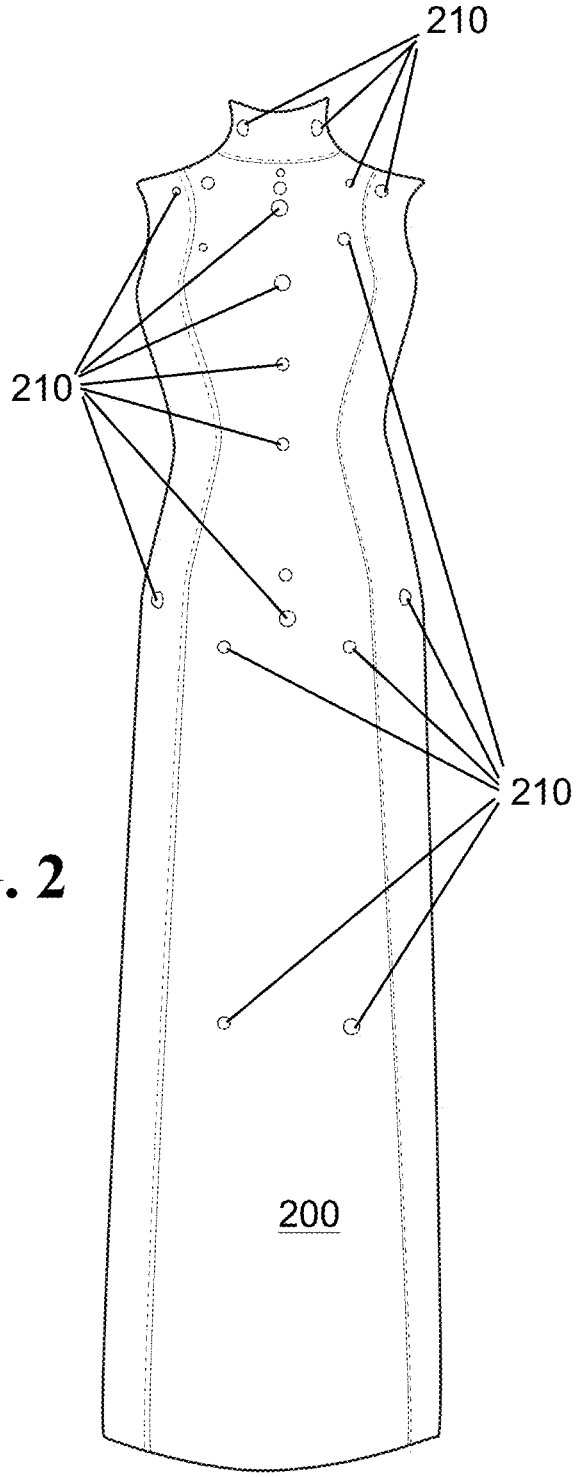
FIG. 2 depicts an exemplary embodiment of the present invention.

FIG. 2 depicts a dress (200) in accordance with the present invention. Dress (200) has a number of nodes (210). Nodes (210) are preferably arranged so as to lie along meridians, or channels, in the body. The placement of nodes (210) on dress (200) or on any garment according to the present invention may be determined by identifying locations on the garment that will coincide with one or more landmarks on the body (e.g., the apex of the shoulder blade) and measuring from the one or more landmarks along meridians, or channels, of the body a specific number of cun (or fractions of cun) or multiples of 1.31 inches. The location of a node may also be determined by measuring from another node instead of from a landmark on the body. Notably, the placement and function of the nodes not only facilitates application of pressure to acupoints, but also contributes to the design and aesthetic of the garment.

Figure 3A:
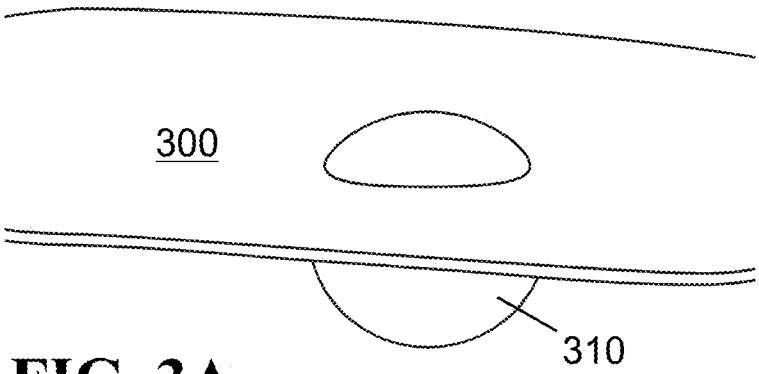
FIGS. 3A and 3B depict an exemplary embodiment of nodes applied to garment material according to the present invention.
Figure 3B:
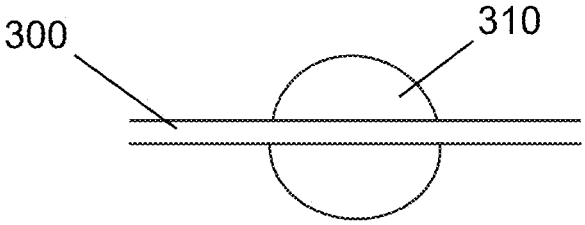

FIGS. 3A and 3B depict an exemplary node (310) incorporated in the material (300) of a garment. Material (300) may be any material suitable for a garment, such as cotton, wool, silk, canvas, suede, polyester, leather, suede, neoprene or denim. Node (310) is depicted in FIGS. 3A and 3B as a sphere. However, the nodes described herein may be any shape, such as an ovoid, a hemisphere, a cube, a pyramid, a cylinder, a icosahedron, a dodecahedron, or a ring. The nodes may also be an item typically included on a garment, such as a button, a rivet, or a bead. The nodes are preferably made from a hard material such as stone, pearl, gem, rock, wood, plastic, ivory, jade, or metal. The outer surface of the nodes is preferably smooth, but may be rough or textured on one or more sides.

Figure 4A:
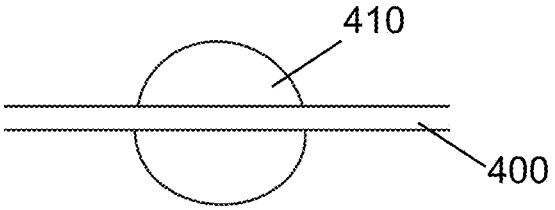
FIGS. 4A-4E depict exemplary embodiments of nodes applied to garment material according to the present invention.
Figure 4B:
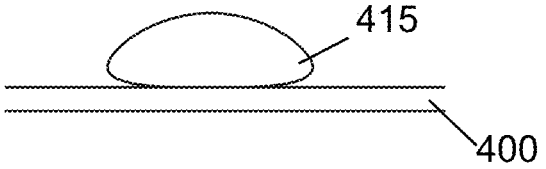
Figure 4C:
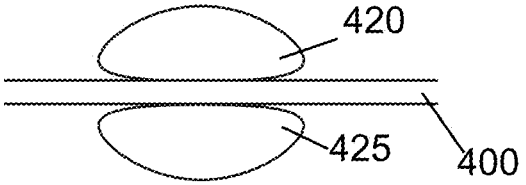

The nodes may also be incorporated in the garment material in a number of different ways. FIGS. 4A-4E depict exemplary ways of incorporating nodes. FIG. 4A depicts a node (410) embedded in material (400). FIGS. 5A-5D, discussed further below, depict exemplary arrangements for inserting nodes through material. FIG. 4B depicts a node (415) attached to one side of material (400). Material (400) may have an outer surface (i.e., a surface of the material facing away from the person wearing the garment or accessory) and an inner surface (i.e., a surface of the material facing toward the person wearing the garment or accessory). Node (415) may be attached to the inner surface or outer surface of material (400) as shown in FIG. 4B. Alternatively, a first node (420) may be attached on the outer surface of the material at a particular location, and a second node (425) may be attached to the inner surface of the material at the same location. Nodes (415, 420, 425) may be attached in a number of ways, such as by using an adhesive (e.g., glue, adhesive film) or hook-and-loop material (i.e., Velcro) between node (415, 420, 425) and material (400) or between two nodes (420, 425).

Additionally or alternatively, nodes (415, 420, 425) may be attached with magnets. For example, node (415) may be a magnet or incorporate a magnet as part of the node, and a magnetic metal (not shown) may be placed on the opposite side of the material as node (415) to hold node (415) in place. Alternatively, node (415) may be a magnetic metal, and a magnet (not shown) may be placed on the opposite side of the material as node (415) to hold node (415) in place. As another example, one of node (420) or (425) may be a magnet or incorporate a magnet as part of the node, and the other node may be a magnetic metal. Alternatively, both nodes (420, 425) may be magnets or incorporate magnets as part of the node. One of nodes (420, 425) may also be attached to material (400) using non-magnetic means (e.g., by an adhesive, hook-and-loop material, sewing the node to material (400)).

Figure 4D:
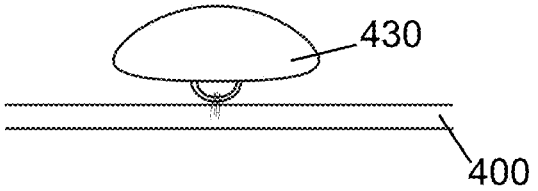
Figure 4E:
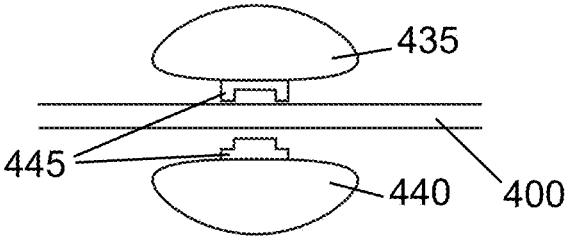

FIG. 4D shows an alternative method for attaching a node (430) to material (400), namely by sewing node (430) or a loop on node (430) to material (400). Node (430) may also be attached using other means such by a pin and clasp. FIG. 4E depicts a first half (435) and second half (440) of a node that may be joined together by two halves of a snap (445). The two halves (435, 440) may also be joined together using other means such, as by welding, screwing as (wherein one node comprises a threaded shaft and the other node comprises a complementary threaded bore, an interference fit, or using a pin and clasp (wherein one node comprises a pin and the other node comprises a clasp), clips, or clamping elements.

Figure 5A:
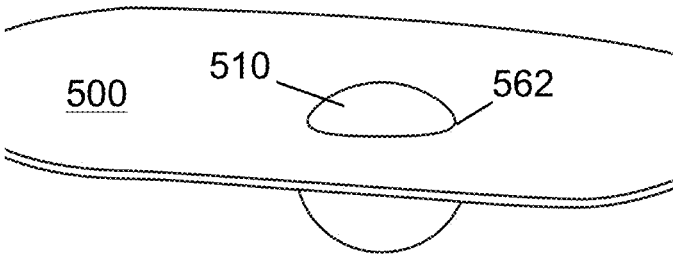
FIGS. 5A-5D depict exemplary embodiments of nodes applied to garment material according to the present invention.
Figure 5B:
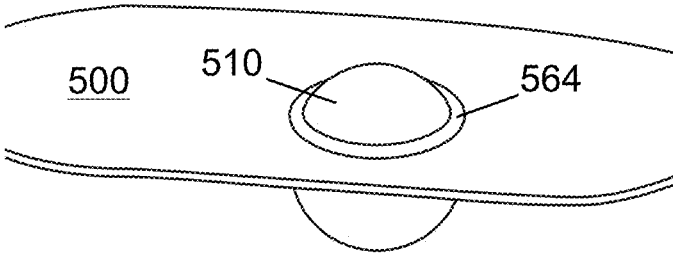
Figure 5C:
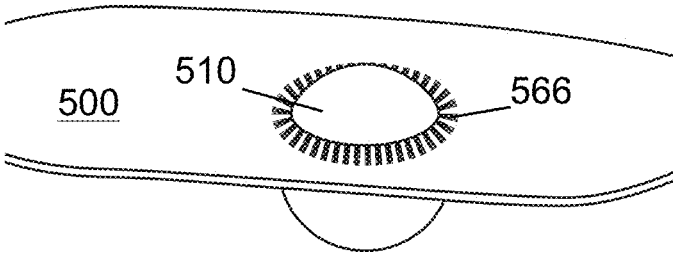
Figure 5D:
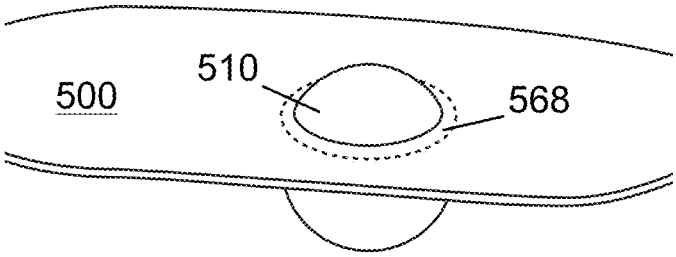

FIGS. 5A-5D show types of apertures and finishes that may be used when incorporating nodes (510) into material (500). FIG. 5A depicts an aperture (562) with a clean finish. FIG. 5B depicts an eyelet (564) to which a node may be attached using, for example, an adhesive or by bonding. FIG. 5C depicts node (510) inserted through a buttonhole (566). FIG. 5D depicts node (510) inserted through an aperture with stay stitch finishing (568).

Figure 6A:
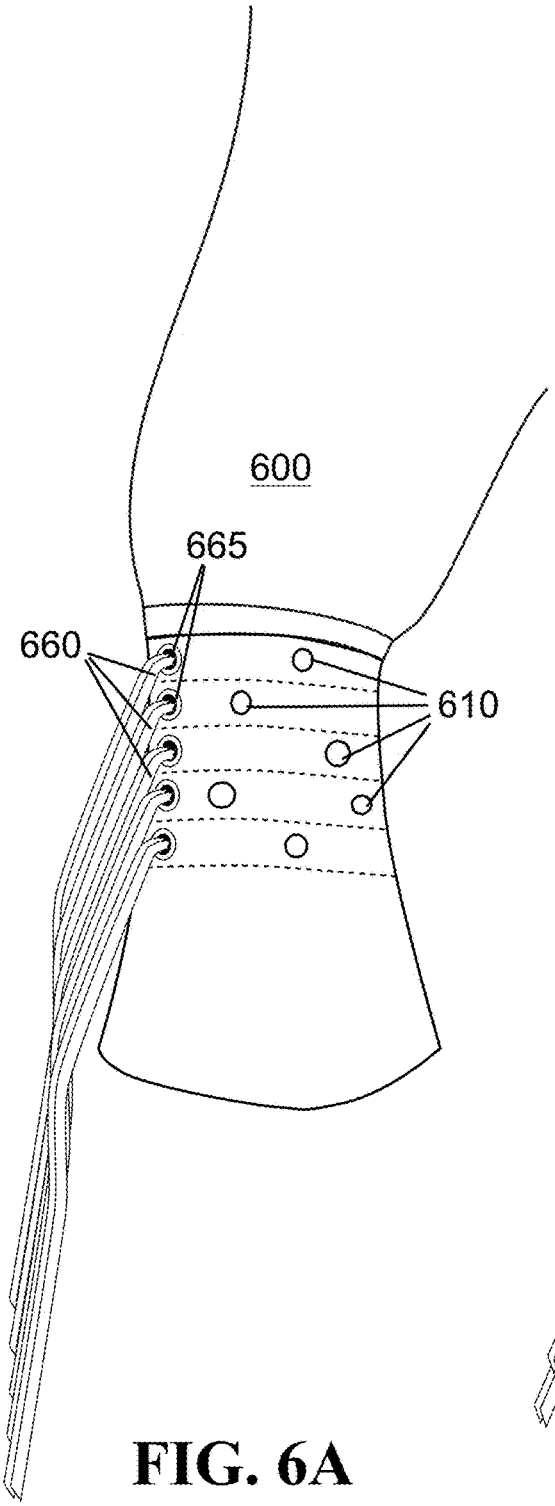
FIGS. 6A and 6B depict an exemplary embodiment of a system for applying nodes according to the present invention.
Figure 6B:
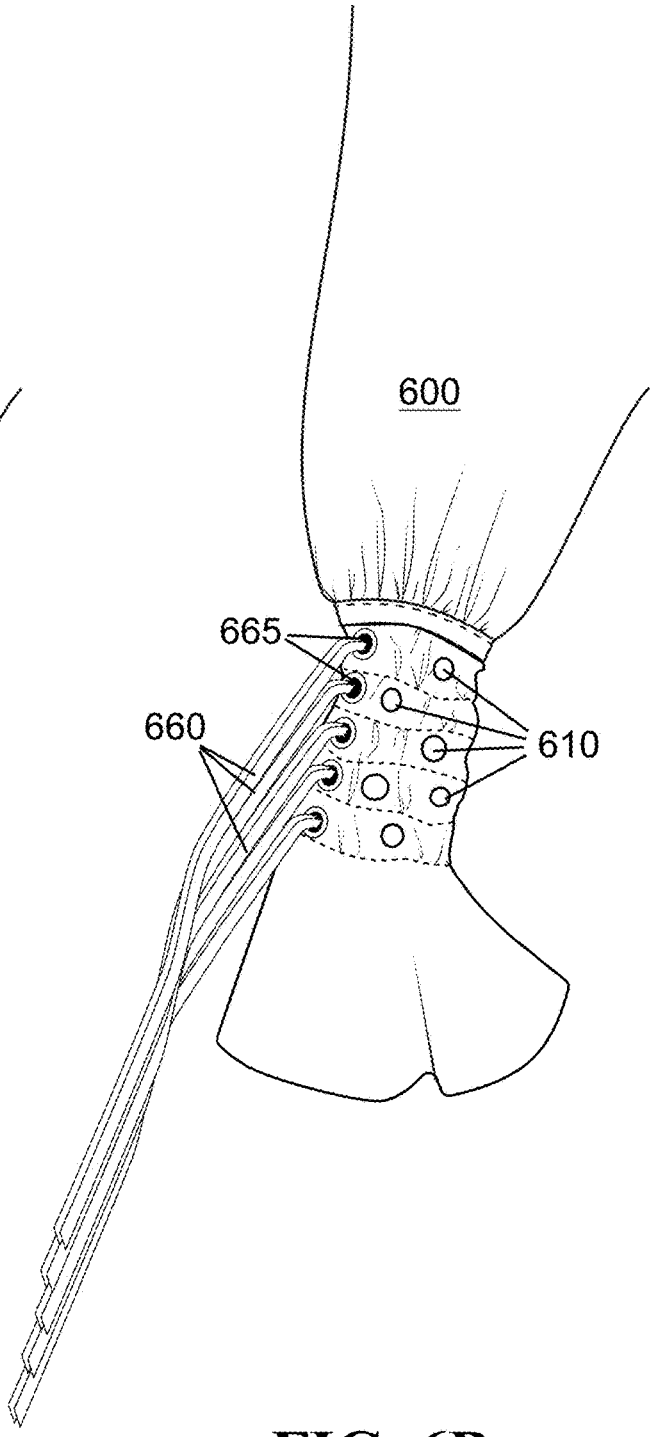
Figure 7A:
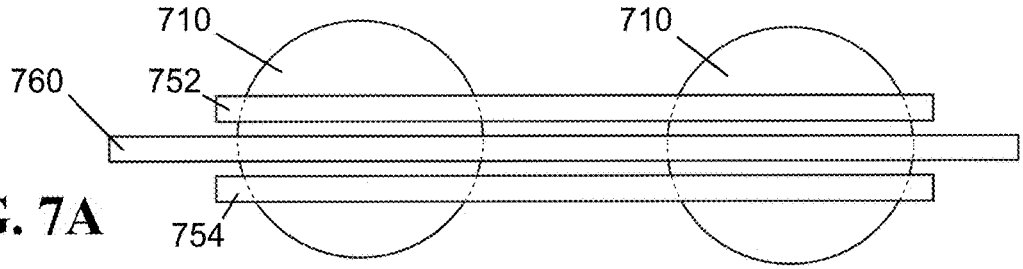
FIGS. 7A and 7B depict an exemplary embodiment of a system for applying nodes according to the present invention.
Figure 7B:
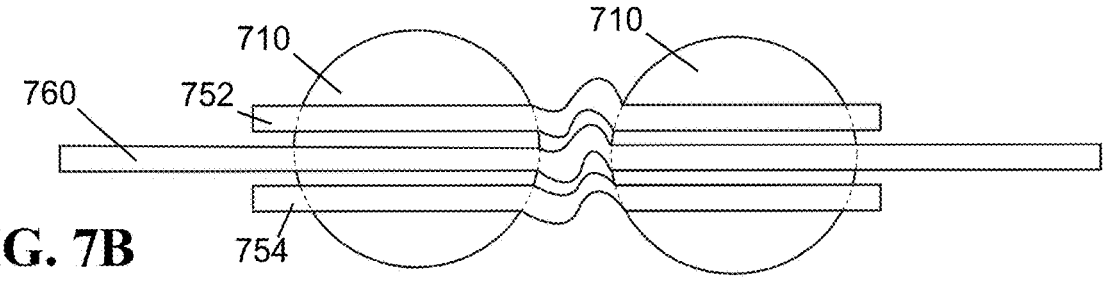

FIGS. 6A and 6B depict a mechanism by which a wearer may control the pressure of nodes. Strands (660) may be inserted through apertures (665) in garment (600). Strands (660) may be, for example, ribbons, strings, or chains. FIGS. 6A and 6B depict a sleeve of garment (600), but the mechanism may be applied to any part of a garment. As shown in further detail in FIGS. 7A and 7B, at least a portion of strands (660, 760) pass between an outer layer (752) and an inner layer (754) of garment (600, 700). Each strand (660, 760) may extend from a first end to a second end. A first end of a strand (660, 760) may be passed through an aperture (665) in the garment and attached to a portion of the garment (600, 700), while the second end of strand (660, 760) extends outside of garment (600, 700). Alternatively, a first end of strand (660) may be passed through a first aperture (665) and passed through a second aperture or the same aperture after being passed between the outer layer (752) and inner layer (754) of the garment.

Figure 8A:
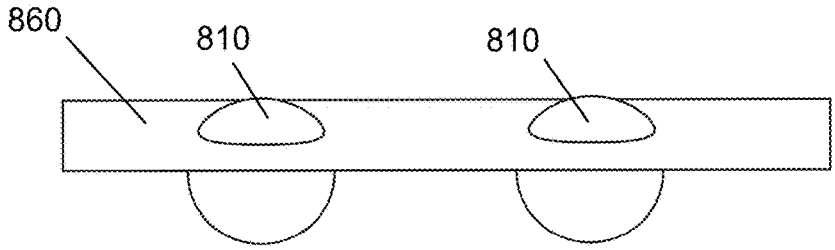
FIGS. 8A-8C depict exemplary embodiments of a system for applying nodes according to the present invention.
Figure 8B:
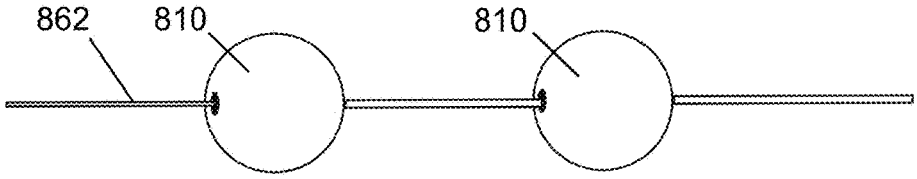
Figure 8C:
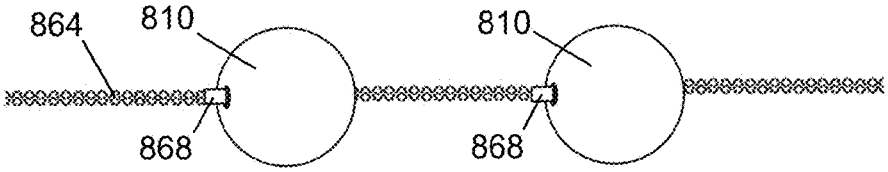

Attached to strands (660, 760) are nodes (610, 710). Nodes (610, 710) may be attached to strands (660, 760) in the same way that the nodes described above may be attached to the garment material. FIGS. 8A-8C show various types of strands and means for attaching nodes to the strands. FIG. 8A shows nodes (810) embedded in a ribbon (860). Ribbon (860) may be made from the same material as the inner layer (752) and/or outer layer (754) of the garment. Alternatively, ribbon (860) may be made from a different material. FIG. 8B depicts nodes threaded along a string or string-like material and held in place by, for example, an adhesive or knots tied in the string or around or through node (810). FIG. 8C depicts strand (864) as a jewelry chain with nodes (810) held in place through with jewelry clamp stoppers (868).

Returning to FIGS. 6A and 6B, when strands (660) are loose, nodes (610) are not pressed against the wearer's body. Healing is deactivated and the wearer cannot feel pressure from the nodes (610). When strands (660) are pulled together and tightened, nodes (610) press against the wearer's skin and stimulate the acupoints where nodes (610) are located.

While the invention has been described in detail with reference to embodiments for the purposes of making a complete disclosure of the invention, such embodiments are merely exemplary and are not intended to be limiting or represent an exhaustive enumeration of all aspects of the invention. It will be apparent to those of ordinary skill in the art that numerous changes may be made in such details, and the invention is capable of being embodied in other forms, without departing from the spirit, essential characteristics, and principles of the invention. Also, the benefits, advantages, solutions to problems, and any elements that may allow or facilitate any benefit, advantage, or solution are not to be construed as critical, required, or essential to the invention. The scope of the invention is to be limited only by the appended claims.

What is claimed is:

1. A garment comprising:

a first node located at a first acupoint of a user when the garment is worn by the user;

a second node located at a second acupoint of the user when the garment is worn by the user;

a strand extending from a first end to a second end, wherein the first node and the second node are in direct contact with the strand;

wherein application of pressure to the first node toward the user is capable of causing the first node to stimulate the first acupoint;

wherein application of pressure to the second node toward the user is capable of causing the second node to stimulate the second acupoint;

wherein the strand is a ribbon;

wherein the garment comprises an outer layer and inner layer and at least a portion of the strand passes between the outer layer and the inner layer; and wherein the first end of the strand extends through a first aperture and passes through the same aperture after passing between the outer layer and the inner layer of the garment.

2. The garment of claim 1, wherein the first node is a sphere.

3. The garment of claim 2, wherein the first node is embedded in the strand.

4. The garment of claim 3, wherein the ribbon has an aperture and the first node is embedded in the aperture with a clean finish.

5. The garment of claim 3, wherein the ribbon has an aperture and the first node is embedded in the aperture with stay stitch finishing.

6. The garment of claim 3, wherein the ribbon has an eyelet and the first node is embedded in the eyelet.

7. The garment of claim 2, wherein the first node is a pearl.

8. The garment of claim 1, wherein the first node has a cylindrical shape.

9. The garment of claim 8, wherein the first node is embedded in the strand.

10. The garment of claim 9, wherein the ribbon has an aperture and the first node is embedded in the aperture with a clean finish.

11. The garment of claim 9, wherein the ribbon has an aperture and the first node is embedded in the aperture with stay stitch finishing.

12. The garment of claim 9, wherein the ribbon has an eyelet and the first node is embedded in the eyelet.

13. The garment of claim 1, wherein the first node is embedded in the strand.

14. The garment of claim 13, wherein the ribbon has an aperture and the first node is embedded in the aperture with a clean finish.

15. The garment of claim 13, wherein the ribbon has an aperture and the first node is embedded in the aperture with stay stitch finishing.

16. The garment of claim 13, wherein the ribbon has an eyelet and the first node is embedded in the eyelet.

* * * * *